United States Patent [19]

Dauser, Jr.

[11] 4,133,596

[45] * Jan. 9, 1979

[54] ELECTRICAL CONNECTOR

[76] Inventor: William C. Dauser, Jr., 458 Melody La., North Muskegon, Mich. 49445

[ * ] Notice: The portion of the term of this patent subsequent to Mar. 22, 1994, has been disclaimed.

[21] Appl. No.: 778,145

[22] Filed: Mar. 16, 1977

Related U.S. Application Data

[63] Continuation-in-part of Ser. No. 591,490, Jun. 30, 1975, Pat. No. 4,013,332.

[51] Int. Cl.[2] ..... H01R 9/08

[52] U.S. Cl. ..... 339/98

[58] Field of Search ..... 339/97–99

[56] References Cited

U.S. PATENT DOCUMENTS

| | | | |
|---|---|---|---|
| 3,820,058 | 6/1974 | Friend | 339/99 R |
| 4,013,332 | 3/1977 | Dauser, Jr. | 339/98 |

*Primary Examiner*—Joseph H. McGlynn

*Attorney, Agent, or Firm*—Price, Heneveld, Huizenga & Cooper

[57] ABSTRACT

A solderless electrical connector assembly includes a base portion formed of an insulating material having wire positioning means for receiving a conductive element and connector positioning means for receiving a connector member. The connecter member is of a conductive material and includes two legs having conductor engaging means. The connector positioning means is oriented so the angle between the axis of the conductor positioning means and a line between the two legs of the connector is less than 90° thereby spacing the legs of the connector along the axis of the conductor. When secured together, the base cooperates with the connector member and the conductive element to deform any insulation from the conductive element and to make positive electrical contact between the connector member and the conductive element. In one embodiment, a plurality of connector and conductor positioning means are oriented in a wiring deck which facilitates splicing multiple groups of conductors together.

41 Claims, 26 Drawing Figures

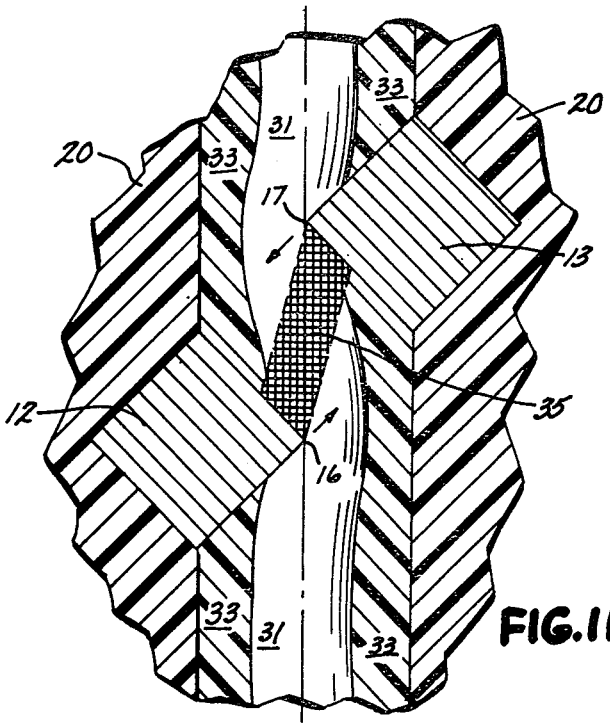
FIG.11.
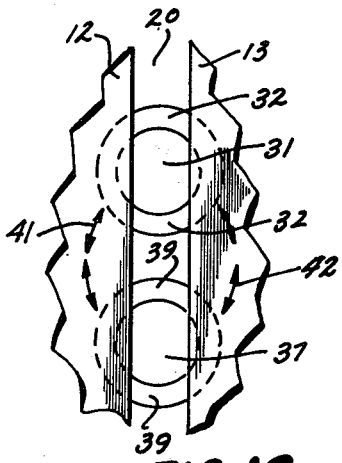
FIG.12.
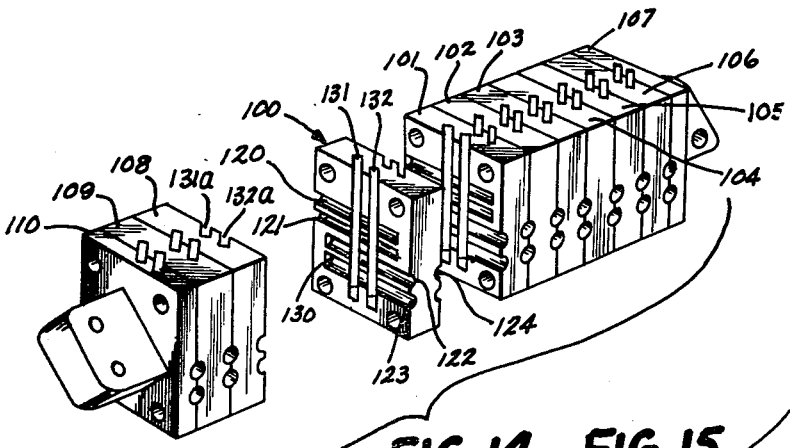
FIG.14.
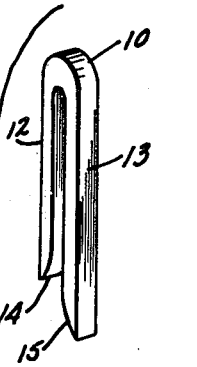
FIG.15
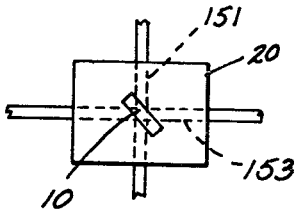
FIG.13.
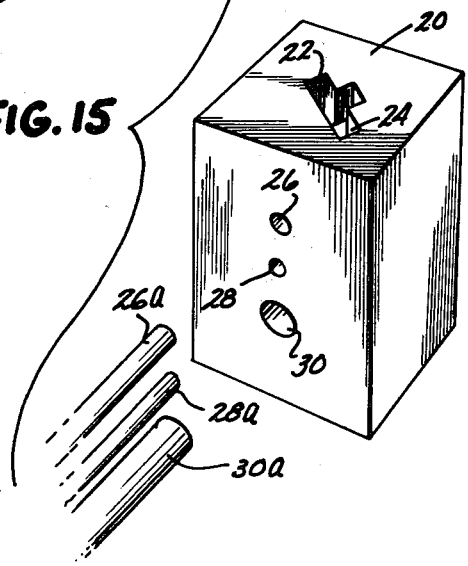

200
210
211
212
213
214
215
216
217
218
219
220
230
232
233
234
235
236
250
251
252
253
254
255
256
257
26
28
124
126
134
104
XXIII
C

ELECTRICAL CONNECTOR

CROSS REFERENCE TO RELATED APPLICATION

This application is a continuation-in-part of my earlier filed application Ser. No. 591,490 entitled ELECTRICAL CONNECTOR and filed by me on June 30, 1975, now U.S. Pat. No. 4,013,332.

BACKGROUND OF THE INVENTION

This invention relates to electrical connectors and more particularly, to solderless electrical connectors such as those used for splicing insulated conductors in telephone and other electrical circuits. Connectors heretofore used for splicing and connecting in electrical circuits generally utilize special terminal blocks in which the wires are positioned. Special tools are required to secure the block and the wires together. To eliminate the possibility of damage from moisture, humidity, and the like, the terminal block is sealed with plastic sleeving or other plastic-like materials to form a weather tight unit. Changes to the circuit and correction or errors are virtually impossible without complete destruction of the connection and usually with destruction of the circuit.

Other techniques also utilized, include individual splicing members in the form of sleeves or the like which are positioned and crimped over the stripped ends of the wire conductors. Special crimping tools are required to fasten the sleeve to the wire ends to form the connection. Additionally, joining different size wire presents difficulties because different size sleeves may be required and the crimping tool may not secure all different sizes of wire with sufficient force. Still other connectors have been utilized wherein a formed connector member including a rigid, slotted plate forms a plurality of rigid jaws in which, when installed, the jaws cut through the insulation and deform the wire conductor. When disconnected, the deformed area of the conductor in which the connection is made may break thereby resulting in destruction of service.

The connectors above described are relatively complex in their construction and in their use and as a result are expensive either in the original cost or in their utilization because of the special tools required.

These objections have been overcome to some degree by U.S. Pat. No. 3,880,489 issued to the inventor of this invention on Apr. 29, 1975 which teaches a connector base which positions wires for engagement by a conductive connector supported within an insulating connector support. The connector assembly taught by the patent requires three members, the base, the conductive connector and the connector support, to form an electrical connection with a wire. Further, either the conductive connector or the connector support must be sufficiently resilient so a compressive force is exerted on the conductor by the conductive connector. Typically, the electrical connector assembly is adapted for use with one size of wire. Additionally, the patent teaches insulation stripping and wire engaging using a flat face of the conductive connector. Fabrication of a connector assembly in accordance with this patent requires formation of three separate components having certain resiliencies and resistances to deformation. Also, stripping insulation with a flat surface requires a certain minimum applied abrasive force.

SUMMARY OF THE INVENTION

The present invention can conductively engage a multiplicity of conductors of widely varying wire gauges in a single connector. The invention also simplifies the construction of an electrical connector, reduces the number of components of the connector and improves the electrical quality of the connection that is made.

In the present invention, a base member includes positioning means for positioning a conductor to be oriented in a first predetermined direction and includes opening means intersecting the positioning means and shaped to receive a conductor engaging connector means which includes two elongated legs including at least two sides thereof intersecting to form cutting edges. The outline of the opening means extends longitudinally in a direction oblique to the first predetermined direction of the positioning means whereby when the legs and a conductor are moved relative to one another, the cutting edges pierce the conductor located within the positioning means and thereby provide an electrical connection between the connector means and the conductor.

In one embodiment of the invention, a plurality of positioning slots and connector receiving slots are located in a wiring deck. A cover is provided for the wiring deck which includes at least two spaced fingers which, when the cover is in position on the deck, are aligned with each conductor positioning slot and extend thereinto and are positioned just to either side of the connector receiving slot whereby when the cover is lowered onto the deck, the fingers press conductor positioned in the conductor positioning slot down between the cutting surfaces of the connector.

BRIEF DESCRIPTION OF THE DRAWINGS

FIG. 11 is a partial cross-sectional view as in FIG. 6 with the addition of a conductor in accordance with an embodiment of this invention;

FIG. 12 is a partial cross-sectional view as in FIG. 9 with the addition of conductors in accordance with an embodiment of this invention;

FIG. 13 is a plan view of a base member with the addition of crossing conductors in accordance with an embodiment of this invention;

FIG. 14 is a perspective view of a modular base comprised of segments in accordance with an embodiment of this invention;

FIG. 15 is an exploded perspective view of an electrical connector assembly having a base, a connector and wires to be electrically connected in accordance with an embodiment of the invention;

DETAILED DESCRIPTION

Figure 1:
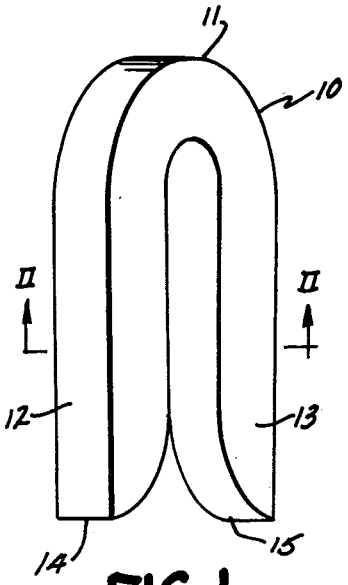
FIG. 1 is a perspective view of a conductor engaging connector formed from a wire in accordance with an embodiment of this invention.

Referring to the drawings, FIG. 15 shows an exploded perspective view of a conductor engaging connector 10 which is configured and aligned to be inserted into a base member 20 through connector positioning slots 22 and 24. Base member 20 also has conductor positioning openings 26, 28 and 30 having their axes aligned in the same plane and passing partly between and partly through connector positioning slots 22 and 24. Conductors 26*a*, 28*a* and 30*a* are aligned to be inserted into conductor positioning openings 26, 28 and 30, respectively. Conductors 26*a*, 28*a* and 30*a* can be of the same wire size, or, as shown in FIG. 15, can be of different sizes. In either case, the connector assembly including connector 10 and base member 20 can cooperate to electrically connect wires 26*a*, 28*a* and 30*a* to each other. The two legs are spaced from each along the axis of a conductor positioning means. Accordingly, each leg can, if desired, intersect more than half the cross section of a conductor positioning opening without cutting a conductor in the opening into two pieces. Although each leg can intersect less than half of the cross section of the conductor positioning means, intersecting at least half of the cross section is advantageous because then no conductor will be too thin to be engaged by the connector.

Connector 10 has a U-shaped junction area 11 connecting legs 12 and 13 having pointed ends 14 and 15, respectively. Legs 12 and 13 of connector 10 are rounded outwardly from the center of connector 10 to form points 14 and 15 (FIG. 15). Preferably, this radiused bottom portion on each leg must be a long, gradual taper to avoid slicing through the conductor. A radius which is about four times the thickness of the conductor or medium of a range of conductors has been found effective for this radius. Connector 10 can be formed from a wire stock having a rectangular cross section and bent at junction area 11.

Preferably, connector 10 is formed of a stiff, rigid wire material and is sufficiently thick that it is stiff and rigid in use. This causes connector 10 to resist spreading when conductor wires are located between its legs. This is important since this resists the transfer of pressures to base member 20. Since base member 20 is made of a nonconductive material, such as a plastic material or the like, it may tend to suffer some deterioration effects over a period of extended use. The more pressures which are imposed on base member 20, the more it will tend to break or crumble with extended life use. Thus, forming connector 10 of a stiff, rigid material such as brass or the like tends to resist the transfer of pressures to base member 20 and extend its useful life.

Base member 20 itself is preferably made of a plastic material which is resistant to deterioration upon temperature cycling of the type encountered in use. Examples of plastic material which would be desirable for use in base member 20 are glass filled polyesters, ABS, rigid PVC, polycarbonates and modified polyphenylene oxides.

Figure 1A:
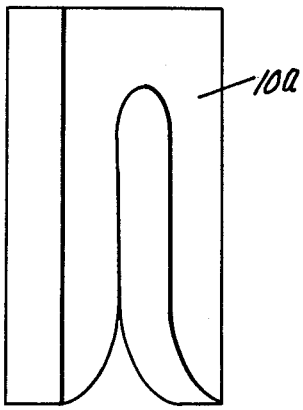
FIG. 1A is a perspective view of a conductor engaging connector stamped from sheet metal in accordance with an embodiment of this invention.

FIG. 1A shows as an alternative embodiment a connector 10*a* which is stamped from sheet metal and has a slightly squared off U-shaped junction area. Connector 10 has an engaging means along the length of its leg for contacting a conductor. As shown in FIG. 1, the engaging means is the corner at the junction of two flat faces. Alternative engaging means include serrated edges along the length of the legs formed by either notching the legs or twisting the legs about their longitudinal axis.

Figure 2:
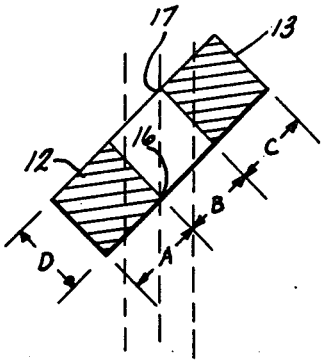
FIG. 2 is a cross-sectional view taken along section line II—II of FIG. 1.

FIG. 2 shows a cross-sectional view of legs 12 and 13 of connector 10 which as shown has an overall cross-sectional outline which is elongated in shape which as disclosed in FIGS. 5, 6, 7 and 15 conform to the overall cross-sectional elongated shape of the combined connector positioning slots 22 and 24. This tightly positions the legs and holds them parallel to one another and holds connector 10 as a whole at the desired oblique angle to the conductors. Dimensions A and C represent the side widths of legs 12 and 13, respectively, dimension D representing the width of leg 12 opposite leg 13 and dimension B representing the distance between legs 12 and 13. Advantageously, dimensions B and D are equal so a good connection can be made when connector 10 is forced around a wire conductor. However, because of specific design considerations such as extremely small conductors, or extremely large bare conductors, it may be desirable to alter either the spacing B or the width D. The dimensions A and C are advantageously equal, but may also be altered to satisfy sliding conditions or other design criteria. A dotted line connecting diagonally opposed corners 16 and 17 of leg 12 and leg 13, respectively, indicates the center line of a conductor positioning opening. Corners 16 and 17 penetrate through any insulation surrounding the conductor and exert a force on the conductive portion of the conductor thereby providing a good electrical contact. Considerations in forming a good electrical contact include having the connector legs a sliding fit in the connector positioning slots, locating the contacting corners near the center line of the conductor positioning openings, and having the outer diameter of the conductor be a relatively close fit with the conductor positioning openings.

Figure 16:
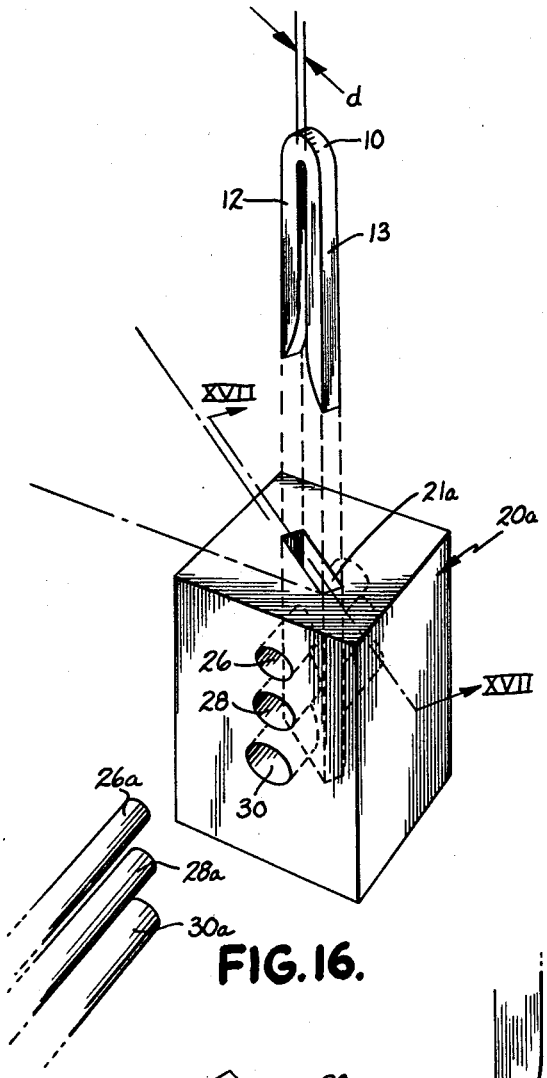
FIG. 16 is a perspective view of an alternative embodiment base member having a continuous opening means for said connector means, with said connector means and three conductors being shown exploded away from said base member.

FIG. 16 illustrates additional principles for obtaining an effective contact between connector 10 and the interior conductive wires of conductors such as 26*a*, 28*a* and 30*a*. It has been found that connector 10 can be successfully used to connect several different size conductors within a range of about 5 numbers in the American Wire Gauge gauging system. Thus, a particular size connector 10 and corresponding base member might accommodate several wires within a range of from 6 to 10 or from 16 through 20, for example. Usually, conductors are commercially available only in every other even number used in the American Wire Gauge System.

Figure 18:
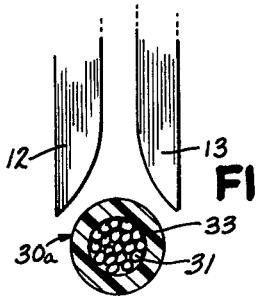
FIG. 18 is an illustration of the legs of the connector means as they are about to slide down over a conductor.

It has been discovered that the optimum distance d (FIG. 16) between the inside facing surfaces of the legs 12 and 13 of connector 10 should be approximately 10% less than the solid wire diameter of the smallest conductor of the predetermined desired range of conductor sizes for which connector 10 is to be used. The "solid wire diameter" refers to the diameter of the conductive wire or bundle of conductive wires 31 within the insulation 33 of a particular wire 30*a*, for example (FIG. 18). Thus, the inside facing surfaces of legs 12 and 13 in connector 10 would be spaced a distance "d" which would be 10% less than the diameter of the bundle of conductive wires 31 within the insulation 33 of conductor 30*a*.

In addition, it has been discovered the oblique angle alpha between the connector receiving opening means (21*a* in the alternative embodiment base member 20*a* shown in FIG. 16) and the predetermined path or plane of the positioning openings 26, 28 and 30 should be between about 15° and about 45°. If alpha is much less than 15°, one begins to encounter difficulties in clearing all of the insulation 33 away and making good contact between the legs 12 and 13 and the conductive wire 31. If alpha is much greater than 45°, one begins to encounter problems of completely cutting through and severing conductor placed within the positioning means 26, 28 or 30.

For larger sized conductors, those larger than 18 gauge as determined by American Wire Gauge standards, the maximum angle of alpha should be about 40° rather than 45°. Thus, the rule must be altered slightly for larger diameter conductors.

Figure 17:
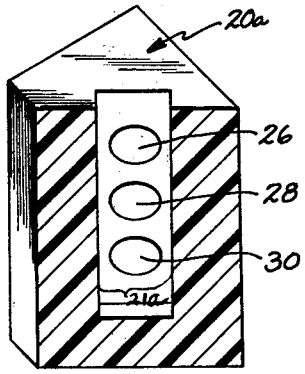
FIG. 17 is a cross-sectional view of the base member of FIG. 16 taken along plane XVII—XVII of FIG. 16.

The alternative embodiment base member 20*a* shown in FIG. 16 is very much like base member 20 shown in FIG. 15, except that the opening means for receiving connector 10 is a continuous open cavity from the top surface of base member 20*a* all the way into base member 20*a* and beyond all of the positioning means 26, 28 and 30. This is illustrated in cross section in FIG. 17. This offers several important advantages over separate openings 22 and 24 for each separate leg 12 and 13 of connector 10. First, it is easier to manufacture a continuously open slot or opening 21*a*. Secondly, and perhaps more importantly, the space immediately above and immediately below an opening 26, 28 or 30, within slot 21*a*, provides space for insulation to spread out and for the solid conductive wire to splay. By giving the insulation 33 a place to spread downwardly as legs 12 and 13 pass the conductor 30*a* (FIG. 18), one insures that the insulation will be pushed away from the solid conductive wiring 31 and allow contact between legs 12 and 13 and the conductive wiring 31. In the previous embodiment 20, as can be seen, for example, in the cross section shown in FIG. 9, there is in essence a pad of solid material, designated 29, located below each of the openings 26, 28 and 30. This block of solid material or pad 29 prevents the insulation 33 from being pushed downwardly.

Figure 18A:
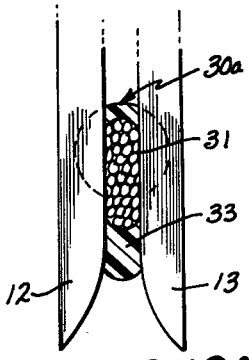
FIG. 18A is an illustration of the legs of a connector after they have slid down over a conductor, showing how the insulation gets pushed down below the conductive wires within the insulation and showing how the conductive wires splay downwardly.

Further, the elimination of these pads 29 allows the solid wire 31 to be splayed downwardly as shown in FIG. 18A. This splaying further minimizes the chances of completely cutting through the solid conductive wiring 31. If the solid conductive wiring has no place to go, there will be more of a tendency for it to be actually severed by the sharp corners on legs 12 and 13.

Figure 4:
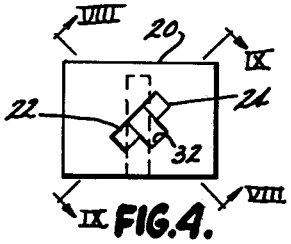
FIG. 4 is a plan view of a base member in accordance with an embodiment of this invention.
Figure 5:
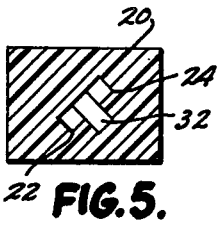
FIG. 5 is a cross-sectional view along section line V—V of FIG. 3.
Figure 6:
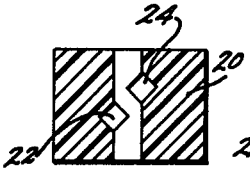
FIG. 6 is a cross-sectional view along section line VI—VI of FIG. 3.
Figure 7:
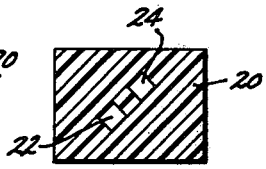
FIG. 7 is a cross-sectional view along section line VII—VII of FIG. 3.
Figure 3:
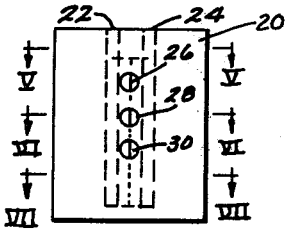
FIG. 3 is a frontal elevation view of a base member in accordance with an embodiment of this invention.
Figure 8:
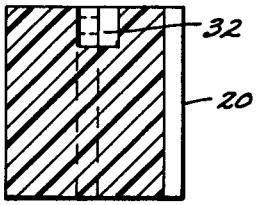
FIG. 8 is a cross-sectional view along section line VIII—VIII of FIG. 4.

Referring to FIG. 3, connector positioning slots 22 and 24 are adapted to receive legs 12 and 13 of connector 10 and are generally rectangular in cross section. Conductor positioning openings 26, 28 and 30 are positioned to intersect openings 22 and 24 so when a conductor is placed in a conductor positioning opening and connector 10 is inserted, corners 16 and 17 of connector 10 will contact the conductor inserted into the opening. FIG. 4 shows a relatively shallow depression 32 between the ends of openings 22 and 24 for inserting a retracting tool such as, for example, a small screwdriver, under U-shape junction area 11 of connector 10 to facilitate removal of plug 10 from base member 20. FIGS. 5–9 show various cross sections of base member 20.

Figure 19:
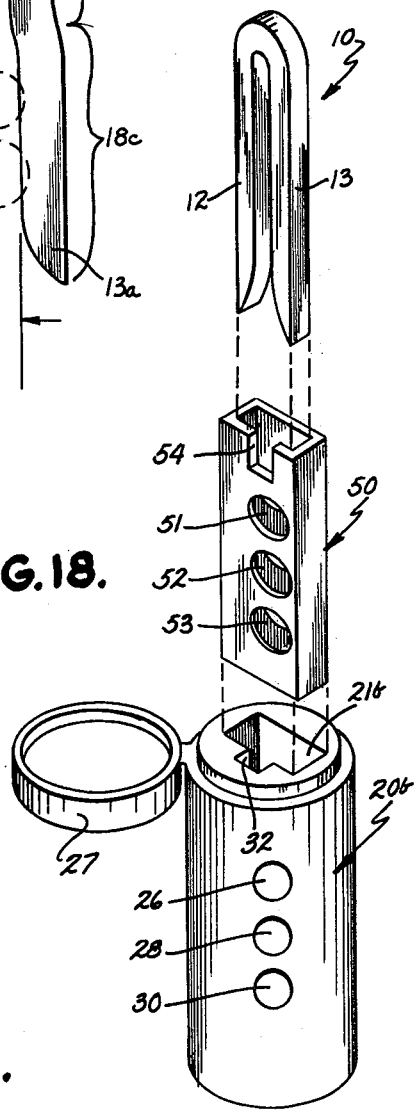
FIG. 19 is a perspective view of an alternative embodiment connector assembly in which a reinforcing sleeve, shown exploded from the base member, is inserted in the base member and the connector is then inserted in the sleeve.

FIG. 19 shows yet another alternative embodiment base member 20*b*. The most important difference between base member 20*b* and the others shown is that its opening 21*b*, which is continuous like opening 21*a*, is adapted to receive a brass sleeve reinforcing insert 50. Brass sleeve 50 is elongated in lateral cross section, and indeed is rectangular in lateral cross section so that it corresponds to the lateral cross section of the combined legs 12 and 13 of connector 10. In this way, the continuously open interior cavity of the brass reinforcing sleeve 50 serves as the opening means which tightly embraces and positions connector 10 and its legs 12 and 13.

The purpose of using brass sleeve reinforcing 50 is that it further minimizes the possibility of transfer of pressure from legs 12 and 13 of connector 10 to the plastic base member 20*b*. Brass sleeve 50 fits tightly and snugly within the opening 21*b* and includes apertures 51, 52 and 53 which in essence form part of the passageways 26, 28 and 30 through which conductors are passed. Brass sleeve 50, in this embodiment, also includes a small notch 54 which corresponds to the tool inserting notch 32 at the top of base member 20*b*.

Base member 20*b* is also different in that it includes a connected cover 27 which can be snapped over to enclose the top of base member 20*b* after conductors and connector 10 have been inserted into their working positions within base member 20*b*.

Figure 10:
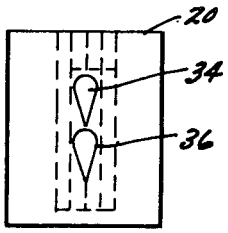
FIG. 10 is a frontal elevation view of a base member in accordance with an embodiment of this invention.

FIG. 10 shows an alternative embodiment of base 20 having teardrop shape conductor positioning openings 34 and 36. A conductor having a larger diameter would go in the upper larger portion of the teardrop and a conductor having a smaller diameter would be wedged into the bottom tapering part of teardrop shaped openings 34 or 36. The insertion of legs 12 and 13 of connector 10 would force the conductor to be wedged against the narrowest part of the teardrop shaped opening which can accommodate the conductor. The teardrop shape opening is advantageous because it can accommodate more than just one size of conductor.

FIG. 13 shows an alternative embodiment of base 20 having conductor 100–110 openings 151 and 153 intersecting between the legs of connector 10. As shown, the conductors in openings 151 and 153 are at right angles to each other and connector 10 is at a 45° angle to the conductors. This configuration is particularly desirable when there is a common conductor or bus to a plurality of connector assemblies with each assembly having a plurality of conductors to be connected to the bus.

FIG. 14 shows a perspective view of modular base member segments 100-110 which are joined together to form a base member adapted for receiving a plurality of connectors and conductors. For example, segment 100 has a concave surface for each conductor receiving opening. A first side of segment 100 has semi-circular concave openings 120, 121, 122 and 123. The other side of segment 100 has concave openings 124 and 125. Other openings on the other side of segment 100 are not visible but correspond to openings 120 and 121. If two such segments are placed side by side then the two concave portions act to make one cylindrical opening for the insertion of a conductor. The conductor can be pushed in until it reaches the end of the opening and is stopped by a wall such as abutment 130. Segment 100 also contains holes for one leg of a connector 10. For example, a leg receiving opening 131 extends through and intersects concave openings 120 and 121. A leg receiving opening **131*a* to act in conjunction with opening 131 to receive the legs of a connector is located in segment 108. A leg opening 132 extends and intersects concave openings 120, 121, 122 and 123. A leg receiving opening 132*a* to act in conjunction with opening 132 to receive the legs of a connector is located in segment 108**.

Figure 20:
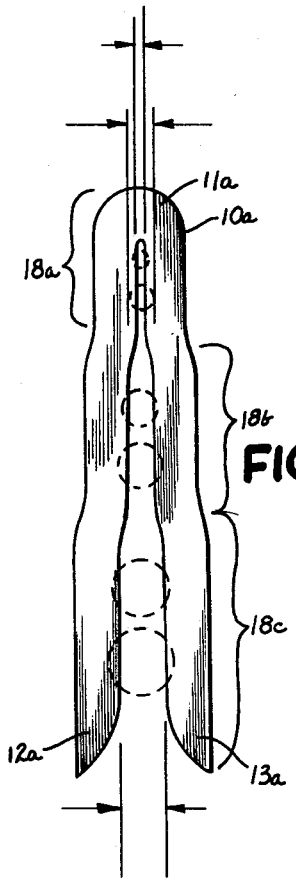
FIG. 20 is an elevational view of an alternative embodiment connector means with illustrations of the different sizes of wiring which can be accommodated by each separate section of the alternative embodiment connector means.

FIG. 20 discloses an alternative embodiment connector **10*a*. The key difference between connector 10*a* and connector 10 is that whereas connector 10 is adapted to receive connectors within a particular five wire gauge range, embodiment 10*a* is adapted to receive connectors within three different five wire gauge ranges. Connector 10*a* is divided into three sections 18, 18 *b* and 18*c*. The facing surfaces of the legs 12*a* and 13*a* are all generally parallel in each of the three sections. These interior facing surfaces in section 18*a*, which is closest to base 11*a* of connector 10*a*, are closest together and are adapted to receive very small wires within a range of, for example, 26 through 30 gauge, in accordance with the American Wire Gauge standards. Legs 12*a* and 13*a* then deviate outwardly slightly so that in section 18*b*, the inside, generally parallel facing surfaces of the legs are spaced slightly farther apart, for accommodating wire within a larger range, of, for example, 20 through 24 gauge. The legs then deviate outwardly again so that in section 18*c*, the inside facing surfaces, which are farthest from base 11*a*, are also the farthest apart. They might be spaced to accommodate even larger wires, as for example in the range of from 14 to 18 gauge. The cross sectioned circles illustrate the different ranges which can be accommodated in the three different sections 18*a* through 18*c*. Naturally, an alternative base member would have to be empolyed having at least one and probably two or three positioning openings therethrough for each separate section 18*a*, 18*b* and 18*c***.

Figure 9:
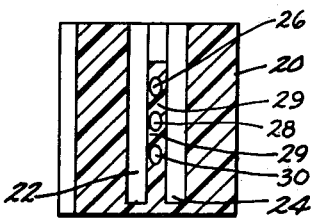
FIG. 9 is a cross-sectional view along section line IX—IX of FIG. 4.

The continuous open interior cavity as in slot **21*a*, for example, or in the interior of reinforcing sleeve 50 offer an important advantage over embodiments such as base member 20 shown in cross section in FIG. 9 relative to the alternative embodiment connector 10*a* in that the deviating legs of the alternative embodiment connector 10*a* could not fit into each of the separate leg receiving slots 22 and 24 shown in base member 20. In contrast, the legs 12*a* and 13*a* of connector 10*a* do slide nicely into the interior of slot 21*a* or the interior cavity of sleeve 50 because of the continuously open nature of the interior of those members and because they have interior widths corresponding to the combined width of the two legs 12*a* and 13*a* of connector 10*a*** at their widest points.

Figures 21, 22, 23, 24:
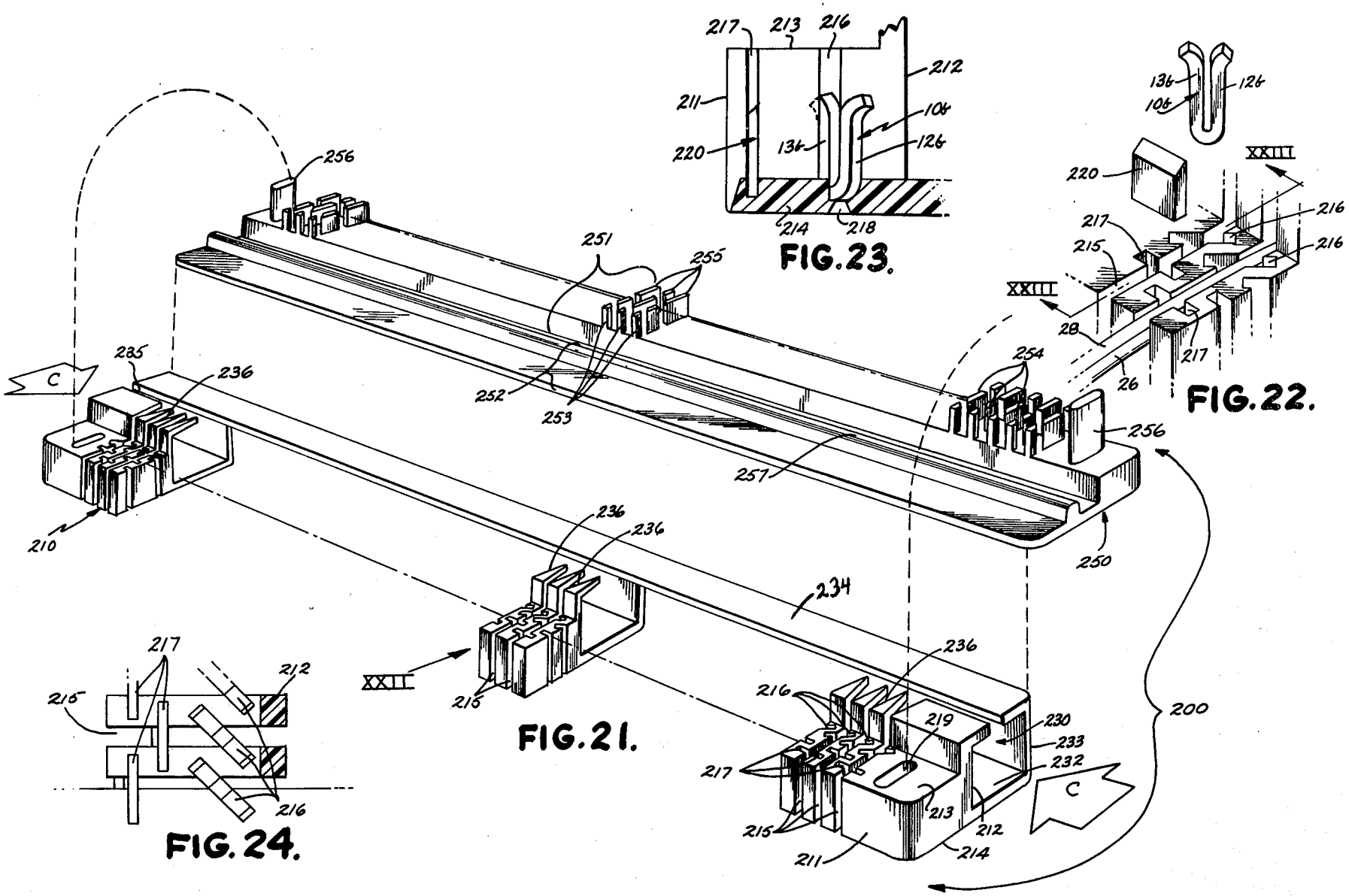
FIG. 21 is a perspective view of a wiring deck with associated cover shown exploded away and folded back.
FIG. 22 is a fragmentary perspective view generally of the area XXII of FIG. 1, with a connector means and a knife blade shown exploded out of their respective positioning slots.
FIG. 23 is a cross-sectional view taken along plane XXIII—XXIII of FIG. 22.
FIG. 24 is a fragmentary, partially cross-sectional and elevational view of that portion of the wiring deck designated area XXII in FIG. 21.

FIG. 21 discloses a cable splicer 200. The front portion as viewed in FIG. 21 is a base member or wiring deck 210 which utilizes a plurality of conductor positioning slots 216 instead of conductor positioning holes such as 26, 28 and 30 disclosed in the base members discussed hereinabove. A connector positioning slot 216 is disposed at an oblique angle to the conductor positioning means 215, and is adapted to receive in closely fitting relation a connector **10*b* (FIGS. 22 and 23) which is similar to connector 10 discussed hereinabove. In operation of cable splicer 200, conductors are forced down into the conductor positioning slot 215 and into the space between the legs 12*b* and 13*b* of connector 10*b***.

Wiring deck 210 includes an outside side surface 211, a spaced inside surface 212, a top surface 213 and a bottom wall 214 (FIGS. 21 and 23). Conductor positioning slot 215 extends laterally through wiring deck 210, opening at both the outside 211 and inside 212. Similarly, it opens at top 213. In this way, a conductor can readily be stretched across wiring deck 210 and down into one of the conductor positioning slots 215.

There are a plurality of these conductor positioning slots 215 throughout the length of wiring deck 210. Since such devices will usually be used to splice 25 pair cables, there must be 50 such conductor positioning slots 215.

For each conductor positioning slot 215, there is a connector positioning slot 216 extending obliquely thereto and intersecting it. The oblique angle serves the function described hereinabove and additionally makes it possible to crowd the conductor positioning slots 215 more closely together since the oblique angle connector positioning slots 216 can "lap" one another without actually intersecting.

Also intersecting each conductor positioning slot 215 is a knife blade positioning slot 217. The slots 217 are staggered as one proceeds from one conductor positioning slot to another to thereby allow the conductor positioning slots 215 to be oriented as closely together as possible. Each knife blade positioning slot 217 intersects and cuts laterally across its respective conductor positioning slot 215. A knife blade 220 is located in knife blade positioning slot 217 with its sharp edge up (FIGS. 22 and 23).

Located at each end of wiring deck 210 is a guide pin receiving hole 219 (FIG. 21). These receive the downwardly projecting guide pins 256 of a separate cover member 250 which will be described more fully hereinbelow.

Located immediately adjacent and formed as an integral part of wiring deck 210 is a cable tunnel 230. Cable 230 is defined on its inside wall by the inside 212 of wiring deck 210. For this reason, the inside wall 212 of wiring deck 210 extends upwardly slightly above the level of top surface 213 to allow a thicker cable to be received within cable tunnel 230. Cable tunnel 230 is further defined by a bottom wall 232, an outside wall 233 and a top wall 234. Each end of cable tunnel 230 is opened, as shown, to allow a cable to be inserted into each end as indicated by the arrows C (FIG. 21).

Top wall 234 includes a top slot 235 extending its entire length. This allows one to separate individual conductors from a cable and feed into the cable positioning slots in wiring deck 210. This feeding operation is further facilitated by the fact that V-shaped notches or guide notches 236 are cut into top wall 234 such that they are widest at their junction with elongated slot 235 and such that they gradually narrow down until they meet with conductor positioning slot 215 in inside wall 212 of wiring deck 210.

Wiring deck 210 and cable tunnel 230 are preferably integrally formed out of a plastic material such as glass filled polyesters, epoxys, polyvinyl chloride, ABS, or other comparable structural plastic materials. Cover 250 is separately integrally formed out of a like plastic.

Cover 250 includes two covering portions, a wiring deck covering portion 251 and a tunnel covering portion 252. Wiring deck covering portion 251 includes a plurality of fingers projecting downwardly therefrom. For each conductor positioning slot 215, there are three fingers which project downwardly from deck covering portion 251 and which, when cover 250 is in place, will project into conductor positioning slot 215. The inside finger 253 and middle finger 254 of each three finger set is positioned so that it falls immediately to either side of the connector receiving slot 216. In this way, once a pair of conductors (26 and 28, for example as shown in FIG. 22) are positioned within conductor receiving slot 215, cover 250 can be lowered into position and the inside finger 253 and mid-finger 254 will serve to push the two conductors downwardly into conductor positioning slot 215 and in between the cutting edges of the legs 12*b* and 13*b* of connector 10*b*. This slices off the insulation and causes electrical contact in the manner described hereinabove. In this regard, each conductor positioning slot 215 is adapted to have a width corresponding to a particular predetermined width or relatively narrow range of widths of conductor so that two conductors placed within each positioning slot 215 will lie one on top of the other, instead of side by side. Yet, each slot 215 is sufficiently deep that at least two conductors can be inserted therein, one above the other.

The outside finger 255 which projects downwardly from deck covering portion 251 of cover 250 is located immediately adjacent knife receiving slot 217 so that as cover 250 is lowered into position, each finger 255 forces the ends of conductors down over the cutting edge of knife blade 217 and thereby cuts off the unwanted ends of the conductors. Mid-finger 254 also cooperates with outside finger 255 in this regard to force conductor down over the cutting edge of knife blade 220.

Projecting downwardly from each end of the deck covering portions 251 of cover 250 is a guide pin 256. This can be integrally formed with cover 250 as plastic, or it can be a separate metal or plastic pin inserted into a receiving slot at the end of cover 250. In either event, guide pin 256 is shaped to fit snugly within the guide pin hole 219 at each end of wiring deck 210. In this way, cover 250 is guided as one pushes it downwardly and one is sure to push the various fingers 253, 254 and 255 properly downwardly into their receiving conductor positioning slots 215.

The tunnel covering portion 252 of cover 250 includes a generally centrally located downwardly projecting rib 257. Rib 257 extends into and closes the elongated slot 235 which extends from end to end of the top wall 234 of cable tunnel 230.

Connector 10*b* is generally like connector 10 discussed above. Its end portions of its respective legs 12*b* and 13*b* are flared outwardly to create the tapered leading inside edges of the legs and the outer excess is not trimmed off to create a perfectly straight exterior surface on each leg. This is unnecessary in this embodiment since connector 10*b* itself does not have to be slid leg first into its connector receiving slot 216. Rather, it is inserted base first as illustrated in FIG. 22 and once in position, the conductor is slid into it to achieve the relative movement desired between conductor and the cutting edges of connector 10*b*. The sides of conductor positioning slots 215 serve to hold the conductors in position during this cutting action. In a sense, the inside and mid-fingers 253 and 254 also serve as positioning means for the conductors since they also serve to locate the conductors as they are pushed downwardly.

There is a test probe opening 218 in the bottom wall 214 of wiring deck 210 which opens out of the bottom and communicates with connector positioning slot 216. This makes it possible to place a test probe through opening 218 (FIG. 23) and contact the base of connector 10*b*. Since the conductors in the cables usually arranged such that one wire is hot and an adjacent wire is ground, one can place one probe of a testig device in one opening 218 and the other probe of the same device in the next adjacent opening 218 and thereby confirm that contact has been made between both the hot pair of wires and the pair of ground wires which have been connected to one another in the adjacent conductor receiving slots 215.

OPERATION

When inserting connector 10 to contact successive conductors inserted in conductor receiving openings 26, 28 and 30 of base member 20, the curved sections on the bottoms of connector 10 with points 14 and 15 successively pierce the insulation of the conductor and wedge into the conductor, slightly displacing it, and compressing a portion of the conductor between legs 12 and 13 of connector 10. Referring to FIGS. 11 and 12, a conductor 31 having insulation 33 is shown contacted by legs 12 and 13. The area of compression between legs 12 and 13 on conductor 31 is shown as cross hatched area 35. Contact between legs 12 and 13 and conductor 31 is provided by pressure of legs 12 and 13 on conductive portion 31 because legs 12 and 13 are braced by base member 20 and because of the elasticity of conductor 31 and insulation 33 resisting the deflection and deformation force of legs 12 and 13 on the conductor. Further, there is a compressive force by a base member 20 on insulation 33 and conductive portion 31 resisting their deflection and further applying force to the electrical connection between legs 12 and 13 and conductor 31.

FIG. 12 shows a cross-sectional view in which an additional conductor 37 having insulation 39 is also contacted by legs 12 and 13. The current paths between conductors 31 and 37 are shown by arrows 41 in leg 12 and arrows 42 in leg 13. Because there are two paths connecting conductors 31 and 37 the resistance is halved from what it would be if there were only one connection between conductors 31 and 37. When connector 10 has reached the bottom of its travel in openings 22 and 24, a slight relaxation of that portion of the conductor between legs 12 and 13 takes place, but the conductor remains under compression thereby maintaining good molecular electrical contact.

If it is desired to remove connector 10 from openings 22 and 24 a rectracting tool can be inserted in opening 32 and under U-shaped section 11 to lift out connector 10. Opening 32 is advantageous because typically the top of U-shaped portion 11 is flush with or below the top of base member 20. After connector 10 is removed from slot 22 and 24 the conductors can be easily removed from the conductor retaining openings.

The embodiment of base member 20 shown in FIG. 14 is particularly advantageous when additional wires are to be connected after some wires have already been connected by a connector. An additional connector is used which is advantageous because the first connector does not have to be moved after contact has been made with initially installed conductors. Such movement may have a tendency to destroy the quality of the electrical connection. An example of a situation when subsequent addition of wires may occur is when some of the wires are installed and connected by a connector at the factory and then there is an additional field installed wire which must be subsequently connected to the factory installed wires. Further, the double connection to those wires contacted by both the first and the second connector is advantageous because it further reduces the resistance of the path between those wires by providing additional legs through which current can flow.

More particularly, a short connector can be inserted into holes 131 and 131*a* connecting the wires placed at the factory in openings 120 and 121 and then, subsequently in the field, a long connector can be inserted in holes 132 and 132*a* making connection to wires in openings 120, 121, 122 and 123. FIG. 14 also shows how modular sections 100 can be used to construct a base member containing a plurality of conductor positioning openings and connector positioning openings. Typically, at each end of an assembled terminal strip are end modules such as 107 and 110 which have concave openings only on the interior side. The modular sections only on the interior side. The modular sections of the terminal strip can be connected by various means such as pins going through the segments connecting them together.

A particularly advantageous method of introducing connector 10 into base member 20 is with an instrument such as a staple gun. Many connections can be rapidly and easily fabricated with such an instrument. This is very desirable when numerous field installed wires must be connected to a modular base segment as discussed above.

The operation of the invention in connection with alternative embodiment 20*a* is like that described above. The only difference is that there is room for the insulation to be pushed aside and for the solid wiring or conductive wiring to splay as shown in FIG. 18A. Similarly, alternative embodiment base member 20*b* is the same in operation as the base member and connector combinations described above. The only difference is the presence of the brass reinforcing sleeve 50 to define the interior of the opening means into which connector 10 is slid.

The use of alternative embodiment connector 10*a* is identical to the use of connector 10. The alternative base member would have at least one conductor receiving positioning opening for each of the three sections 18*a*, 18*b* or 18*c* of connector 10*a*.

The use of cable splicer 200 is of course somewhat more sophisticated than the use of simple connector such as base members 20, 20*a* and 20*b* described above. Basically, the individual wires off of each of the two cables which are to be spliced are fed through top slot 35, through a particular guide notch 236 and into a particular conductor positioning slot 216. Once all of the pairs of conductors are properly located in the desired positioning slots 216, cover 250 is lowered into position, utilizing guide pins 256 within guide pin receiving holes 219 to insure proper orientation. By pushing cover 250 downwardly, one pushes the conductors into position between the cutting edges of the legs of the particular connector 10*b* employed and one also severs the unwanted ends of the conductors over knife blade 220.

Typical materials for connector 10 include phosphor bronze, berillium copper, tempered aluminum and other similar metals. The connector may or may not be plated with a higher conductivity material. A typical material for base member 20 is a plastic which is resistant to deformation.

Various modifications and variations will no doubt occur to those skilled in the various arts to which this invention pertains. For example, the angular relationship of a conductor and a connector may be varied. Further, base segments may be connected in a plurality of different ways so a common line runs through all of them providing a common bus connection connected by connectors to all other conductors in the base member. These and all other variations which basically rely on the teachings through which this disclosure has advanced the art are properly considered within the scope of this invention as identified by the appended claims.

The embodiments of the invention in which an exclusive property or privilege is claimed are defined as follows:

1. An electrical connector assembly adapted to be electrically conductively connected to an elongated conductor comprising: a conductor engaging connector means including a base with two elongated legs extending from said base and spaced from each other, said legs including at least two sides thereof intersecting to form cutting edges; said combined legs in transverse cross section at their widest point being defined by an outline which is elongated in shape; a base member having a positioning means for positioning a conductor to be oriented in a first predetermined direction; opening means in the base member intersecting said positioning means, the overall combined, transverse, cross-sectional shape of said opening means defined by an outline which has an elongated shape essentially the size and shape as said outline defining the overall shape of said legs at their widest point; said elongated outline of said opening means extending longitudinally in a direction oblique to said first predetermined direction of said positioning means whereby when said legs and a conductor are moved relative to one another said cutting edges pierce the conductor located within said positioning means and thereby providing an electrical connection between said connector means and the conductor.

2. The electrical connector assembly of claim 1 in which said base member includes a top surface and spaced sides; said positioning means comprising a slot through said base member opening at said top and at said spaced sides whereby wiring can be pushed down into said slot; said opening means in said base member also opening at said top of said base member; said connector being oriented within said opening with its said base oriented away from said top surface of said base member and its said legs projecting upwardly towards said top surface of said base member where a conductor can be forced downwardly into said slot between said legs of said connector.

3. The electrical connector assembly of claim 2 in which said slot is deep enough from said opening at said top surface of said base member to accommodate at least two conductors, one above the other, of a predetermined size range and said slot having a width from side to side only sufficient to accommodate therebetween one conductor of said predetermined size range; said cutting edges of said connector projecting into said slot to thereby pierce the insulation on said conductors when they are forced into said slot, and said cutting edges being spaced a sufficient distance apart that they do not completely cut through the solid wire located within said insulation.

4. The electrical connector assembly of claim 3 in which said positioning means includes a separate cover for said base member, said cover including spaced fingers aligned with and located in said slot when said cover is in position on said base member, said spaced fingers being located on opposite sides of said opening means whereby said fingers force conductors down into said slot by applying pressure thereon adjacent the opposite sides of said opening means.

5. The assembly of claim 1 in which each of the legs have a flat surface forming with a respective intersecting side thereof the said cutting edges, said flat surfaces spaced from and opposing each other, said cutting edges being spaced and located diagonally from each other; said flat surfaces being located on parallel planes which when said connector is located in said opening means intersect said positioning means at an oblique angle whereby when said legs are pushed through said opening means and are guided and oriented thereby the said cutting edges extend into said positioning means and thereby pierce said conductor.

6. The electrical connector assembly of claim 5 in which said positioning means comprises a plurality of passageways extending through said base member and intersecting said opening means, each passageway being adapted to receive a conductor, and each of said passageways of said plurality of passageways being of differing diameters to receive different sized conductors.

7. The electrical connector assembly of claim 1 in which said positioning means comprises a plurality of passageways extending through said base member and intersecting said opening means, each passageway being adapted to receive a conductor, and each of said passageways of said plurality of passageways being of differing diameters to receive different sized conductors.

8. The electrical connector assembly of claim 7 in which said plural passageways range in size over a five wire guage range in accordance with American Wire Gauge sizes.

9. The electrical connector assembly of claim 1 in which said opening means is a continuous open cavity from a first surface of said base into said base and beyond said positioning means in said base.

10. The assembly of claim 9 in which each of the legs have a flat surface forming with a respective intersecting side thereof the said cutting edges, said flat surfaces spaced from and opposing each other, said cutting edges being spaced and located diagonally from each other; said flat surfaces being located on parallel planes which when said connector is located in said opening means intersect said positioning means at an oblique angle whereby when said legs are pushed through said opening means and are guided and oriented thereby the said cutting edges extend into said positioning means and thereby pierce said conductor.

11. The electrical connector assembly of claim 9 in which said legs include facing surfaces spaced from one another a distance which is approximately 10% less than the solid wire diameter of the smallest conductor of a predetermined desired range of conductor sizes; said oblique angle between said elongated outline of said opening means and said direction of said positioning means being between about 15° and about 45°.

12. The electrical connector assembly of claim 9 in which said positioning means comprises a plurality of passageways extending through said base member and intersecting said opening means, each passageway being adapted to receive a conductor, and each of said passageways of said plurality of passageways being of differing diameters to receive different sized conductors.

13. The electrical connector assembly of claim 12 in which said plural passageways range in size over a five wire gauge range in accordance with American Wire Gauge sizes.

14. The electrical connector assembly of claim 1 in which said legs include facing surfaces spaced from one another a distance which is approximately 10% less than the solid wire diameter of the smallest conductor of a predetermined desired range of conductor sizes; said oblique angle between said elongated outline of said opening means and said direction of said positioning means being between about 15° and about 45°.

15. The electrical connector assembly of claim 14 in which said oblique angle is between about 15° and about 40° when said positioning means is adapted to receive conductors of 18 gauge or larger as determined by American Wire Gauge standards.

16. The assembly of claim 14 in which each of the legs have a flat surface forming with a respective intersecting side thereof the said cutting edges, said flat surfaces spaced from and opposing each other, said cutting edges being spaced and located diagonally from each other; said flat surfaces being located on parallel planes which when said connector is located in said opening means intersect said positioning means at an oblique angle whereby when said legs are pushed through said opening means and are guided and oriented thereby the said cutting edges extend into said positioning means and thereby pierce said conductor.

17. The electrical connector assembly of claim 14 in which said positioning means comprises a plurality of passageways extending through said base member and intersecting said opening means, each passageway being adapted to receive a conductor, and each of said passageways of said plurality of passageways being of differing diameters to receive different sized conductors.

18. The electrical connector assembly of claim 17 in which said plural passageways range in size over a five wire gauge range in accordance with American Wire Gauge sizes.

19. The electrical connector assembly of claim 18 in which said oblique angle is between about 15° and about 40° when said positioning means is adapted to receive conductors of 18 gauge or larger as determined by American Wire Gauge standards.

20. The electrical connector assembly of claim 1 in which said opening means is lined with a reinforcing sleeve made of a material less subject to age deterioration than the material of said base member, said reinforcing sleeve being located in said opening means and defining the outline thereof.

21. The assembly of claim 20 in which each of the legs have a flat surface forming with a respective intersecting side thereof the said cutting edges, said flat surfaces spaced from and opposing each other, said cutting edges being spaced and located diagonally from each other; said flat surfaces being located on parallel planes which when said connector is located in said opening means intersect said positioning means at an oblique angle whereby when said legs are pushed through said opening means and are guided and oriented thereby the said cutting edges extend into said positioning means and thereby pierce said conductor.

22. The electrical connector assembly of claim 20 in which said opening means and the interior of said reinforcing sleeve are a continuous open cavity from a first surface of said base member into said base member and beyond said positioning means in said base member.

23. The electrical connector assembly of claim 20 in which said legs include facing surfaces spaced from one another a distance which is approximately 10% less than the solid wire diameter of the smallest conductor of a predetermined desired range of conductor sizes; said oblique angle between said elongated outline of said opening means and said direction of said positioning means being between about 15° and about 45°.

24. The electrical connector assembly of claim 20 in which said base member is made of a nonconductive material and said reinforcing sleeve is a metal.

25. The electrical connector assembly of claim 24 in which said base member is a plastic.

26. The electrical connector assembly of claim 1 in which said connector is of a rigid, stiff material whereby pressure transfer from said connector legs to said body member is minimized.

27. The electrical connector assembly of claim 26 in which said opening means is a continuous open cavity from a first surface of said base into said base and beyond said positioning means in said base.

28. The electrical connector assembly of claim 26 in which said legs include facing surfaces spaced from one another a distance which is approximately 10% less than the solid wire diameter of the smallest conductor of a predetermined desired range of conductor sizes; said oblique angle between said elongated outline of said opening means and said direction of said positioning means being between about 15° and 45°.

29. The electrical connector assembly of claim 26 in which said opening means is lined with a reinforcing sleeve made of a material less subject to age deterioration than the material of said base member, said reinforcing sleeve being located in said opening means and definig the outline thereof.

30. The assembly of claim 26 in which each of the legs have a flat surface forming with a respective intersecting side thereof the said cutting edges, said flat surfaces spaced from and opposing each other, said cutting edges being spaced and located diagonally from each other; said flat surfaces being located on parallel planes which when said connector is located in said opening means intersect said positioning means at an oblique angle whereby when said legs are pushed through said opening means and are guided and oriented thereby the said cutting edges extend into said positioning means and thereby pierce said conductor.

31. The electrical connector assembly of claim 30 in which said connector is brass.

32. The electrical connector assembly of claim 1 in which: said connector has a plurality of sections at which said legs have facing surfaces which are generally parallel to one another, said surfaces in the section closest to said base being spaced from one another a first distance to accommodate a first predetermined range of conductor sizes, said facing surfaces in subsequent sections being spaced successively farther apart from one another as one proceeds from section to section in a direction away from said base, to accommodate successively larger predetermined wire size ranges in each successive section; a plurality of said positioning means, at least one said positioning means for each said section of said connector, each said positioning means being adapted to accommodate the particular predetermined wire size range corresponding to that of its respective connector section.

33. The electrical connector assembly of claim 32 in which each said section and its respective positioning means are adapted to receive conductors within a wire size range of five gauges as established by the American Wire Gauge standards.

34. The electrical connector assembly of claim 32 in which said opening means is a continuous open cavity from a first surface of said base into said base and beyond said positioning means in said base.

35. The electrical connector assembly of claim 32 in which said legs include facing surfaces spaced from one another a distance which is approximately 10% less than the solid wire diameter of the smallest conductor of a predetermined desired range of conductor sizes; said oblique angle between said elongated outline of said opening means and said direction of said positioning means being between about 15° and about 45°.

36. The electrical connector assembly of claim 32 in which said opening means is lined with a reinforcing sleeve made of a material less subject to age deterioration than the material of said base member, said reinforcing sleeve being located in said opening means and defining the outline thereof.

37. The electrical connector assembly of claim 32 in which said connector is of a rigid, stiff material whereby pressure transfer from said connector legs to said body member is minimized.

38. The electrical connector assembly of claim 32 in which each of said legs is of a generally uniform cross section from its said base to its end, said different spacings between the said interfaces of said legs in said different sections being achieved by said legs deviating outwardly as they proceed from section to section in said connector means.

39. The electrical connector assembly of claim 38 in which each said positioning means comprises a plurality of passageways extending through said base member and intersecting said opening means, each passageway being adapted to receive a conductor, and each of said passageways of said plurality of passageways being of differing diameters to receive different sized conductors.

40. The electrical connector assembly of claim 32 in which each said positioning means comprises a plurality of passageways extending through said base member and intersecting said opening means, each passageway being adapted to receive a conductor, and each of said passageways of said plurality of passageways being of differing diameters to receive different sized conductors.

41. The electrical connector assembly of claim 40 in which said plural passageways range in size over a five wire gauge range in accordance with American Wire Gauge sizes.

* * * * *

UNITED STATES PATENT AND TRADEMARK OFFICE

CERTIFICATE OF CORRECTION

PATENT NO. : 4,133,596

DATED : January 9, 1979

INVENTOR(S) : William C. Dauser, Jr.

It is certified that error appears in the above-identified patent and that said Letters Patent are hereby corrected as shown below:

Column 1, line 24:

"or" should be --- of ---;

Column 7, line 11:

"100-110" should be --- positioning ---;

Column 7, line 50:

"18 b" should be --- 18b ---;

Column 8, line 2:

"empolyed" should be --- employed ---;

Column 10, line 38:

"testig" should be --- testing ---;

Column 12, line 61:

after "means" insert --- being ---;

UNITED STATES PATENT AND TRADEMARK OFFICE

CERTIFICATE OF CORRECTION

PATENT NO. : 4,133,596

DATED : January 9, 1979

INVENTOR(S) : William C. Dauser, Jr.

It is certified that error appears in the above-identified patent and that said Letters Patent are hereby corrected as shown below:

Column 15, line 68:

"definig" should be -- defining --.

Signed and Sealed this

*Fourteenth* Day of *August 1979*

[SEAL]

*Attest:*

*Attesting Officer*

LUTRELLE F. PARKER

*Acting Commissioner of Patents and Trademarks*